US006180905B1

(12) United States Patent
Pollock et al.

(10) Patent No.: US 6,180,905 B1
(45) Date of Patent: Jan. 30, 2001

(54) TWO POSITION PUSHBUTTON SWITCH WITH ILLUMINATED BUTTON

(75) Inventors: Scott J. Pollock, Ypsilanti; Ralph T. Varney, Gaines, both of MI (US)

(73) Assignee: TRW Inc., Lyndhurst, OH (US)

( * ) Notice: Under 35 U.S.C. 154(b), the term of this patent shall be extended for 0 days.

(21) Appl. No.: 09/476,532

(22) Filed: Jan. 3, 2000

(51) Int. Cl.[7] ..... H01H 19/62
(52) U.S. Cl. ..... 200/527; 200/314
(58) Field of Search ..... 200/527–529, 200/523, 314

(56) References Cited

U.S. PATENT DOCUMENTS

| | | | | |
|---|---|---|---|---|
| 4,104,981 | | 8/1978 | Ono et al. . | |
| 4,891,476 | * | 1/1990 | Nation et al. | 200/11 R |
| 4,996,401 | * | 2/1991 | Park | 200/527 |
| 5,049,709 | * | 9/1991 | Prickett et al. | 200/527 |
| 5,145,059 | * | 9/1992 | Park | 200/527 |
| 5,180,050 | | 1/1993 | Rada et al. . | |
| 5,226,529 | * | 7/1993 | Valenzona | 200/529 |
| 5,586,645 | * | 12/1996 | Bartok | 200/527 |
| 5,844,203 | * | 12/1998 | Chasen | 219/256 |

* cited by examiner

*Primary Examiner*—Michael L. Gellner
*Assistant Examiner*—Nhung Nguyen
(74) *Attorney, Agent, or Firm*—Tarolli, Sundheim, Covell, Tummino & Szabo L.L.P.

(57) ABSTRACT

A pushbutton switch (10) includes a printed circuit board (14) having first and second traces (18, 20) spaced circumferentially apart about an axis (22) and a housing (40) connected to the circuit board. The housing (40) includes a chamber (80) in which a movable assembly (100) is partially disposed. The movable assembly (100) has electrical contacts (198) for engaging one or the other of the first and second traces (18 and 20) on the circuit board (14). A button (12) is connected with the movable assembly (100). The button (12) is manually depressible toward the circuit board (14). A spring (220) biases the movable assembly (100) and the button (12) away from the circuit board (14). A plurality of angled surfaces (84, 92, 126, 172) on the movable assembly (100) cooperate to cause the movable assembly to rotate about the axis (22) when the button (12) is manually depressed toward the circuit board (14). The movable assembly (100), when rotated, toggles between a first condition in which the first trace (18) is engaged by the contacts (198) and a second condition in which the second trace (20) is engaged by the contacts.

14 Claims, 6 Drawing Sheets

TWO POSITION PUSHBUTTON SWITCH WITH ILLUMINATED BUTTON

TECHNICAL FIELD

The present invention relates to a pushbutton switch, and is particularly directed to a two position pushbutton switch having an illuminated button.

BACKGROUND OF THE INVENTION

Two position pushbutton switches are used in many applications. One such application is a so-called "window lockout" switch in an automobile. The window lockout switch is typically mounted in an arm rest panel near the driver of the automobile. The window lockout switch is manually depressible to toggle between two axial positions. In one axial position, the window lockout switch electrically disables the rocker switches which the passengers would normally use to operate the automobile's power windows. In the other axial position, the window lockout switch electrically enables the rocker switches adjacent each of the passenger windows so that the passengers can operate the respective power window adjacent their seat in the automobile. The window lockout switch is particularly useful to families with small children.

SUMMARY OF THE INVENTION

The present invention is a pushbutton switch comprising a printed circuit board having first and second traces spaced circumferentially apart about an axis and a housing connected to the printed circuit board. The housing includes a chamber centered on the axis. A movable assembly is centered on the axis and is partially disposed in the chamber. The movable assembly has electrical contacts for engaging one or the other of the first and second traces on the printed circuit board. A button is connected with the movable assembly. The button is manually depressible toward the printed circuit board. The pushbutton switch has means for biasing the movable assembly and the button away from the printed circuit board, and means for rotating the movable assembly about the axis when the button is manually depressed toward the printed circuit board. The movable assembly, when rotated, toggles between a first condition in which the first trace is engaged by the electrical contacts and a second condition in which the second trace is engaged by the electrical contacts.

The pushbutton switch further comprises a light bulb mounted to the printed circuit board and means for conducting light from the light bulb to an illuminatable portion of the button. The light bulb is located on a bulb axis which is parallel to and offset from the axis.

BRIEF DESCRIPTION OF THE DRAWINGS

The foregoing and other features of the present invention will become apparent to those skilled in the art to which the present invention relates upon reading the following description with reference to the accompanying drawings, wherein.

DESCRIPTION OF A PREFERRED EMBODIMENT

Figure 1:
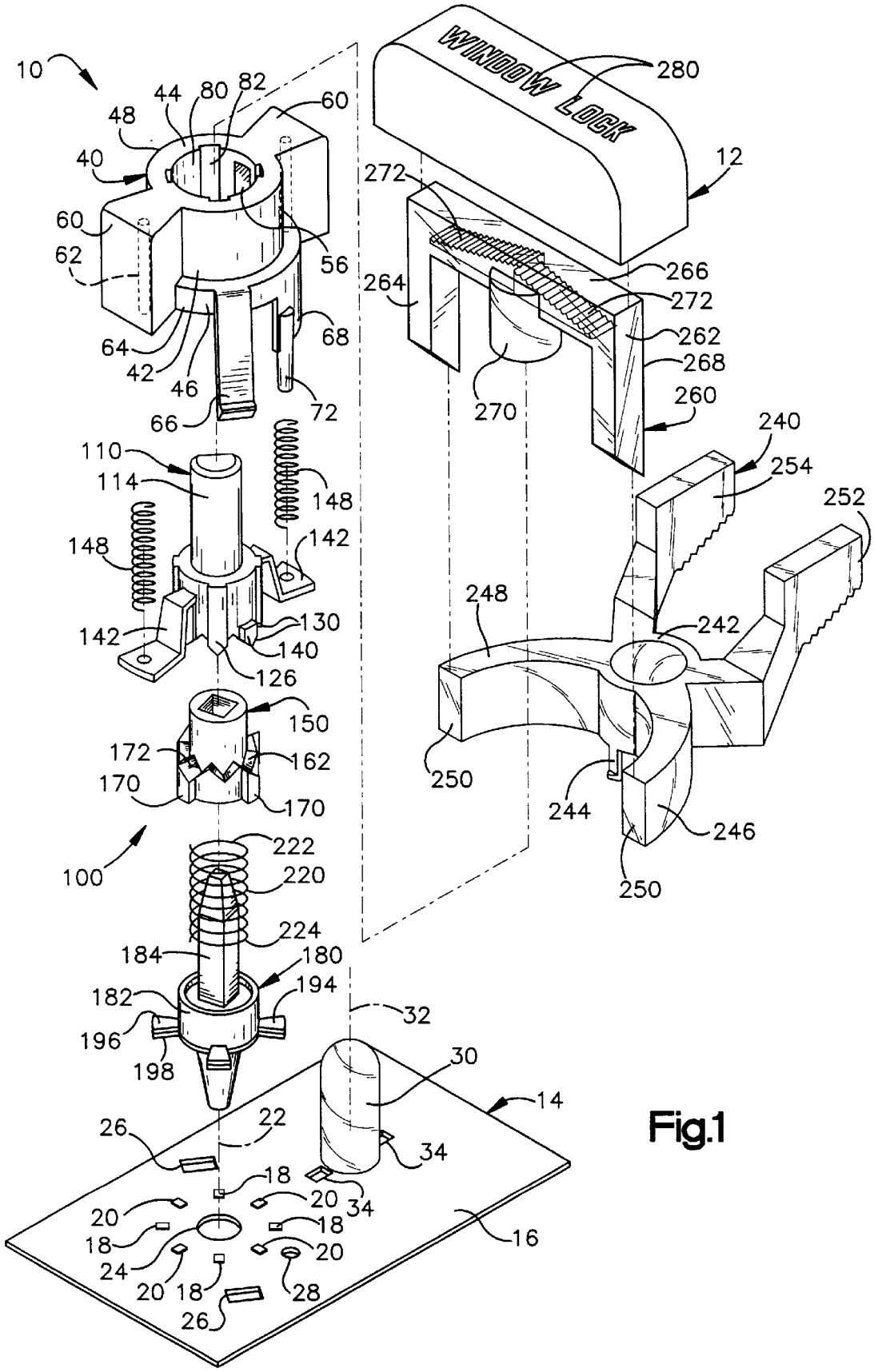
FIG. 1 is an exploded perspective view of a pushbutton switch constructed in accordance with the present invention.

The present invention relates to a pushbutton switch, and is particularly directed to a two position pushbutton switch 10 having an illuminated button 12. The switch 10 has numerous applications. As representative of a preferred embodiment of the present invention, FIG. 1 illustrates the switch 10 as a power window lockout switch for an automobile. The switch 10 is mounted in an arm rest panel (not shown) near the driver's seat in the automobile, along with a respective rocker switch (not shown) for operating each of the automobile's power windows (not shown). Additional rocker switches (not shown) are located adjacent each power window in the automobile so that a passenger seated next to a given power window can operate the power window.

The switch 10 includes a printed circuit board 14 having an upper surface 16. The upper surface 16 of the printed circuit board 14 includes first and second electrical traces 18 and 20, only portions of which are visible in FIG. 1. The first and second traces 18 and 20 are spaced circumferentially about a switch axis 22 in an alternating pattern. The first and second traces 18 and 20 are operatively electrically coupled to circuits (not shown) which control each of the automobile's power windows. When an electrical circuit is completed through the first trace 18, each power window in the automobile may be operated using either the rocker switch adjacent a particular power window or the respective rocker switch in the driver's arm rest panel. When an electrical circuit is completed through the second trace 20, the individual rocker switches adjacent each window are electrically disabled and only the rocker switches near the driver can operate the power windows.

The printed circuit board 14 includes a clearance hole 24 centered on the switch axis 22. The clearance hole 24 is located radially inward from the first and second traces 18 and 20. A pair of rectangular mounting holes 26 extend through the printed circuit board 14 at diametrically opposed locations which are radially outward of the traces 18 and 20. The printed circuit board 14 includes an orientation hole 28 lying adjacent one of the mounting holes 26.

A cylindrical light bulb 30 is mounted to the printed circuit board 14. The light bulb 30 extends along a bulb axis 32 which is parallel to, but offset from, the switch axis 22. The light bulb 30 is electrically connected to the automobile's electrical system (not shown) so that the bulb illuminates when the automobile's headlamps (not shown) are illuminated. A pair of square mounting holes 34 are located on opposite sides of the light bulb 30.

The switch 10 includes a housing 40 attached to the printed circuit board 14. The housing 40 has a main body portion 42 with oppositely disposed first and second ends 44 and 46. A cylindrical outer surface 48 extends between the first and second ends 44 and 46. The housing 40 has a cylindrical first inner surface 50 (FIG. 3) at the first end 44 and a cylindrical second inner surface 52 at the second end 46. The second inner surface 52 has a larger diameter than the first inner surface 50. A pair of diametrically opposed slots 56 (FIG. 10) extend between the outer surface 48 and the inner surfaces 50 and 52. The slots 56 extend axially from the second end 46 toward the first end 44.

A pair of box-shaped enclosures 60 project radially outward from the main body portion 42 of the housing 40. The enclosures 60 are located diametrically opposite one another and are radially aligned with the slots 56 in the housing 40. The enclosures 60 are open at an end which faces toward the second end 46 of the main body portion 42. Each enclosure 60 includes an axially extending spring pilot 62.

The second end 46 of the main body portion 42 of the housing includes an annular flange 64. A diametrically opposed pair of mounting tabs 66 project downward (as viewed in FIG. 1) from the flange 64. The mounting tabs 66 are radially deflectable and snap into the mounting holes 26 in the printed circuit board 14 to secure the housing 40 to the printed circuit board. A pair of arcuate segments 68, only one of which is visible in FIG. 1, also project downward from the flange 64. The arcuate segments 68 lie on opposite sides of the switch axis 22 and are located between the mounting tabs 66. The arcuate segments 68 have end surfaces 70 (FIG. 10) which rest on the upper surface 16 of the printed circuit board 14 to stabilize the housing 40 on the circuit board. A cylindrical orientation pin 62 (FIG. 1) projects from one of the arcuate segments 68 and into the orientation hole 28 in the printed circuit board 14.

The first and second inner surfaces 50 and 52 of the main body portion 42 of the housing 40 together define a chamber 80 centered on the switch axis 22. The first inner surface 50 includes four minor grooves 82 which extend axially from the first end 44 toward the second end 46. The four minor grooves 82 are spaced 90° apart. Each minor groove 82 terminates at an angled housing surface 84 (FIG. 2) which extends radially from each minor groove to the second inner surface 52.

The second inner surface 52 in the housing 40 includes two diametrically opposed major grooves 86. The major grooves 86 are spaced 90° from the slots 56 in the main body portion 42 of the housing 40. The major grooves 86 extend axially from the second end 46 of the main body portion 42 toward the first end 44. The major grooves 86 extend radially farther into the main body portion 40 than the minor grooves 82. Each of the major grooves 86 terminates at a groove end surface 88 (FIG. 12) which extends radially between the major groove and the first inner surface 50.

Figure 2:
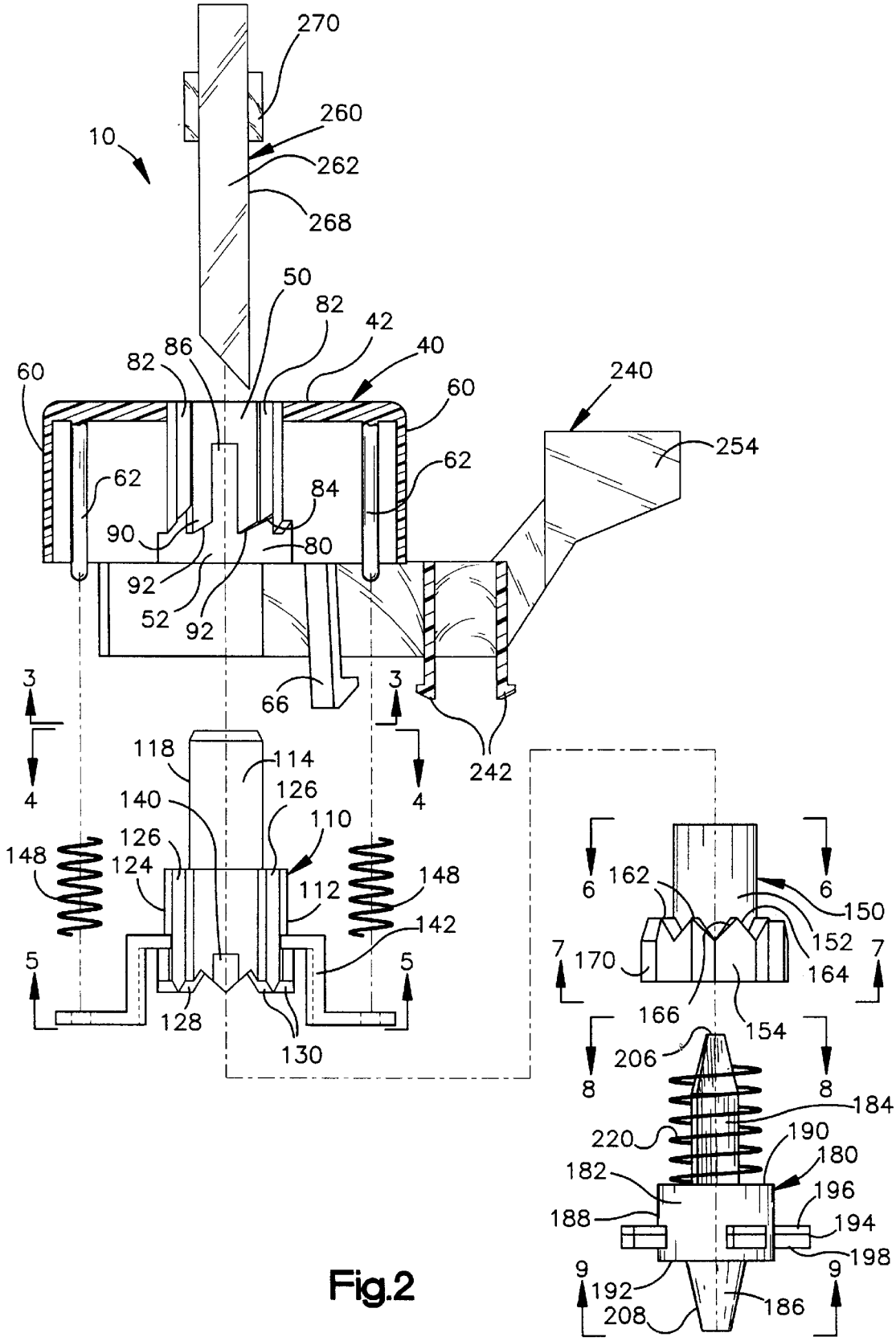
FIG. 2 is an exploded side view, partly in section, of parts of the pushbutton switch shown in FIG. 1.

Inside the chamber 80 in the housing 40, the major grooves 86, the minor grooves 82, and the slots 56 are all separated from each other by a plurality of guide bars 90 (FIG. 2). The guide bars 90 extend axially from the first end 44 of the main body portion 42 of the housing 40 toward the second end 46. The guide bars 90 have the same diameter as the first inner surface 50. Each of the guide bars 90 terminates at an angled guide surface 92 which extends radially outward from each guide bar to the second inner surface 52. The angled guide surfaces 92 extend at approximately the same angle as the angled housing surfaces 84. Further, every other one of the angled guide surfaces 92 extends co-linearly from a respective one of the angled housing surfaces 84.

Figure 4:
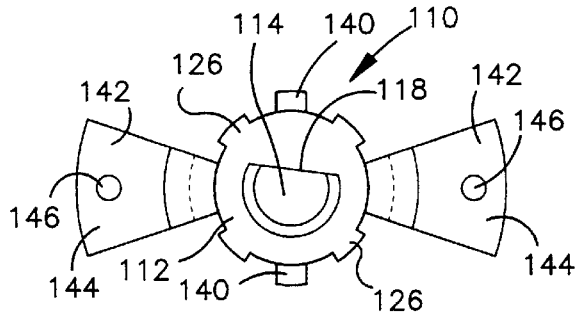
FIG. 4 is an end view taken along line 4—4 in FIG. 2.

The switch 10 further includes a movable assembly 100 partially disposed in the chamber 80 in the housing 40. The movable assembly 100 includes a shaft 110, a driver 150, and a rotor 180. The shaft 110 has first and second body portions 112 and 114. The first body portion 112 is disposed in the chamber 80 and the second body portion 114 projects out of the chamber through the first end 44 of the housing 40. The second body portion 114 has a D-shaped cross-section defined by a partially cylindrical surface 116 (FIG. 4) and a planar surface 118.

Figure 5:
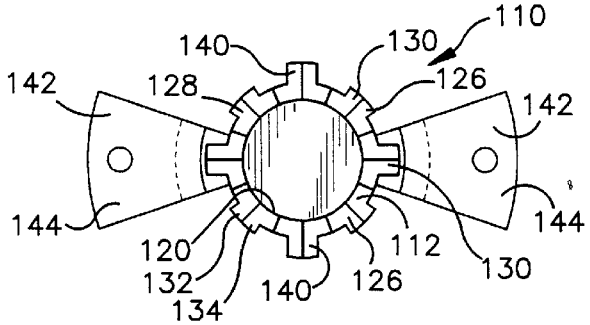
FIG. 5 is an end view taken along line 5—5 in FIG. 2.

The first body portion 112 of the shaft 110 has a cylindrical inner surface 120 (FIG. 5) which defines a cavity 122 inside the shaft. The first body portion 112 has a cylindrical outer surface 124 (FIG. 2) which is larger in diameter than the second body portion 114. The outer surface 124 of the first body portion 112 includes four axially extending ridges 126 (FIG. 4) that are disposed in the minor grooves 82 in the chamber 80 in the housing 40. The ridges 126 terminate at a lower (as viewed in the figures) end surface 128 of the shaft 110. The lower end surface 128 comprises a circumferential array of axially pointing teeth 130. The array includes eight teeth 130 equally spaced apart. Each of the teeth 130 is defined by first and second angled surfaces 132 and 134 which converge to form a tooth point.

Adjacent the lower end surface 128 of the shaft 110, the outer surface 124 of the first body portion 112 further includes two diametrically opposed radial projections 140, and two diametrically opposed legs 142 which are spaced 90° from the projections. One of the four ridges 126 is located between each of the projections 140 and each of the legs 142. The two projections 140 are thicker in the radial direction than the ridges 126 and are disposed in the two major grooves 86 in the chamber 80 in the housing 40. The projections 140 terminate at the lower end surface 128 and merge into two of the eight teeth 130.

Figure 10:
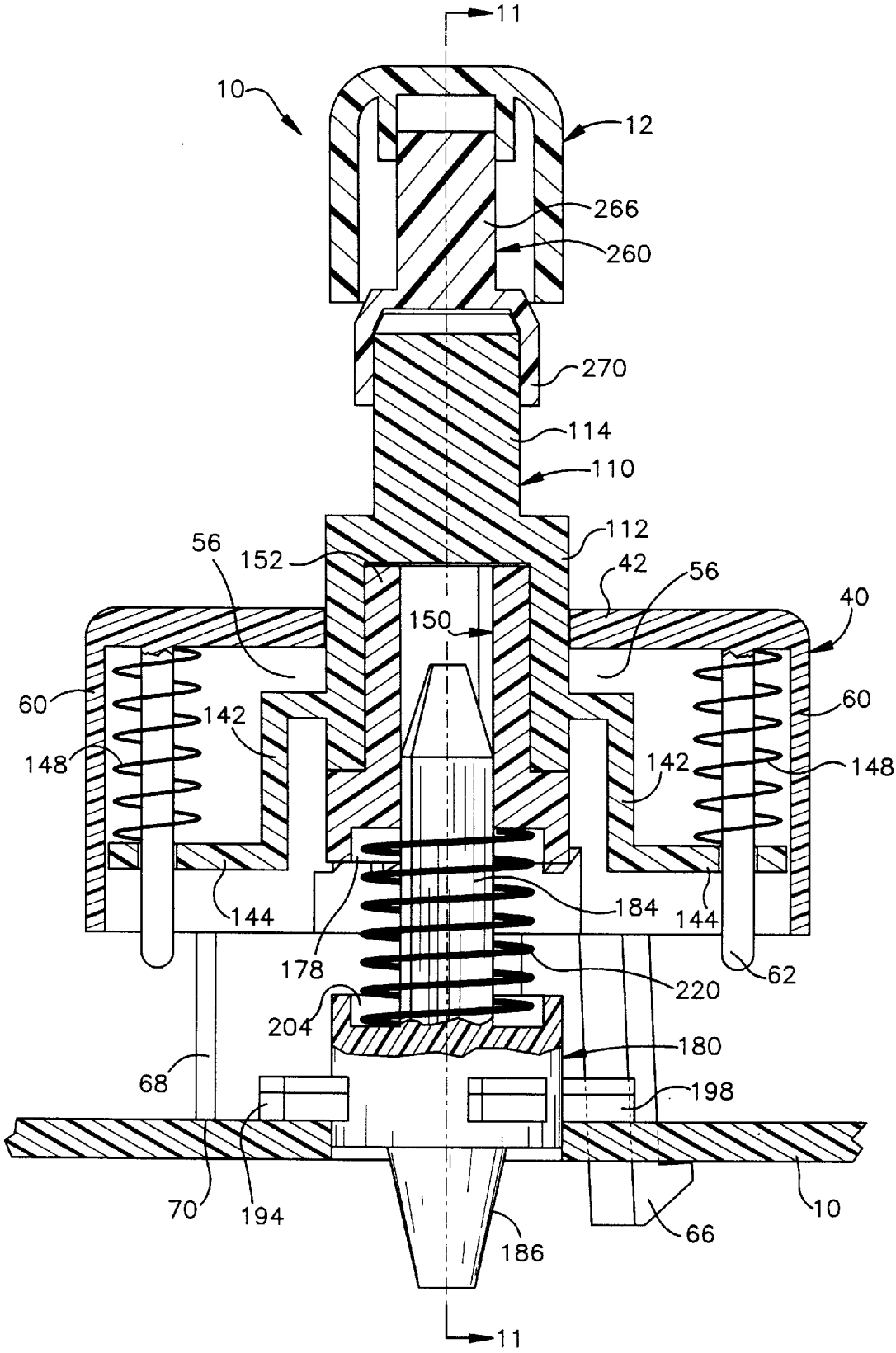
FIG. 10 is a sectional view showing a portion of the pushbutton switch of FIG. 1 in an assembled state.

Another two of the eight teeth 130 at the lower end surface 128 of the shaft 110 are located underneath the two legs 142. The legs 142 project both radially and axially from the first body portion 112 of the shaft 110. The legs 142 extend through the slots 56 in the housing 40. Each leg 142 includes a radially extending end wall 144 which closes the open end of the enclosures 60 on the housing 40 as shown in FIG. 10. The end walls 144 have openings 146 for receiving the spring pilots 62.

A spring 148 is disposed inside each of the enclosures 60 in the housing 40. The springs 148 fit over the spring pilots 62 and engage the end wall 144 on each of the legs 142. The springs 148 bias the shaft 110 away from the housing 40 to prevent vibration of the shaft inside the housing which would tend to generate undesired audible noise and cause wear to occur.

Figure 6:
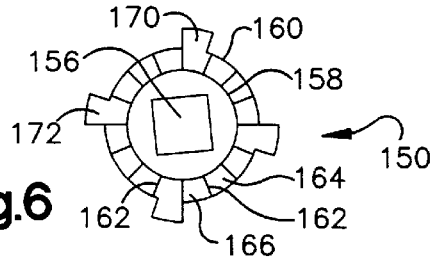
FIG. 6 is an end view taken along line 6—6 in FIG. 2.

The driver 150 is partially disposed in the cavity 122 in the shaft 110. The driver 150 includes first and second sections 152 and 154 (FIG. 2) and has a square bore 156 (FIG. 6) extending through both sections. The first section 152 has a cylindrical outer surface 158 which fits inside the cavity 122 in the shaft 110. The second section 154 also has a cylindrical outer surface 160 and is larger in diameter than the diameter of the outer surface 158 of the first section 152. The first and second sections 152 and 154 are connected by a circumferential array of eight axially pointed teeth 162. The eight teeth 162 are defined by a plurality of radially extending first and second angled surfaces 164 and 166 (FIG. 2) which intersect to form the teeth 162. The teeth 162 on the driver 150 correspond in size and shape to the eight teeth 130 on the shaft 110 and are engageable with the teeth on the shaft.

Figure 7:
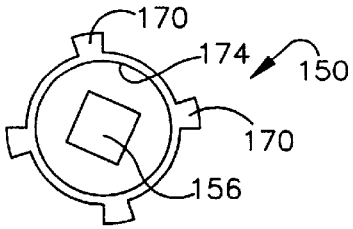
FIG. 7 is an end view taken along line 7—7 in FIG. 2.
Figure 9:
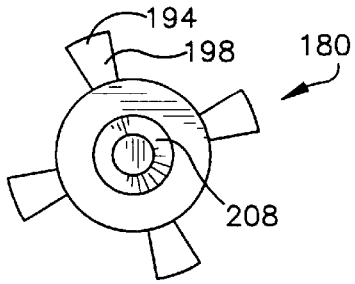
FIG. 9 is an end view taken along line 9—9 in FIG. 2.

The second section 154 of the driver 150 includes four wedge portions 170 (FIG. 1) equally spaced apart around the circumference of the driver. The wedge portions 170 extend radially outward from the outer surface 160 of the second section 154. Each wedge portion 170 has an angled wedge surface 172 facing toward the first section 152 of the driver 150 and which blends into a respective one of the first angled surfaces 164 defining each of the teeth 130 on the driver. The second section 154 of the driver 150 further includes a cylindrical inner surface 174 (FIG. 7) and a radial surface 176 which together define a pocket 178 (FIG. 10) in the second section.

The rotor 180 (FIG. 2) is partially disposed in the bore 156 through the driver 150. The rotor 180 includes a central portion 182 and first and second shaft portions 184 and 186. The central portion 182 has a cylindrical outer surface 188 and first and second ends 190 and 192. Four equally spaced tabs 194 project radially outward from the outer surface 188. Each tab 194 includes a support portion 196 and a copper contact 198 attached to the support portion. The contacts 198 lie on the upper surface 16 of the printed circuit board 14 and are engageable with one or the other of the first and second traces 18 and 20.

Figure 8:
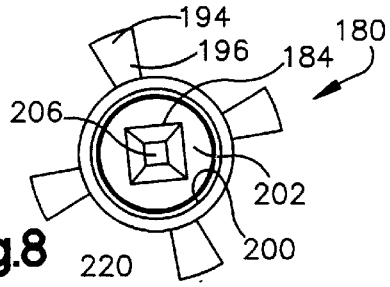
FIG. 8 is an end view taken along line 8—8 in FIG. 2.

The first end 190 of the central portion 182 of the rotor 180 includes a cylindrical inner surface 200 (FIG. 8) and a radial surface 202 which together define a pocket 204 (FIG. 10) at the first end. The first shaft portion 184 of the rotor 180 projects from the pocket 204 at the first end 190. The first shaft portion 184 has a square cross-section and converges toward a planar tip 206. The first shaft portion 184 is partially disposed in the square bore 156 through the driver 150 and connects the rotor 180 for rotation with the driver. The second shaft portion 186 has a frustoconical outer surface 208 and is received in the clearance hole 24 through the printed circuit board 14.

A spring 220 (FIG. 1) fits over the first shaft portion 184 of the rotor 180. A first end 222 of the spring 220 is disposed in the pocket 178 in the second section 154 of the driver 150, and a second end 224 of the spring is disposed in the pocket 204 in the central portion 182 of the rotor 180, as shown in FIG. 10. The spring 220 biases the driver 150 and the shaft 110 away from the rotor 180 and the printed circuit board 14. The spring 220 also opposes movement of the shaft 110 toward the circuit board 14 and thus provides the return stroke for the switch 10. Further, the spring 220 acts indirectly against the housing 40 and helps to secure the switch 10 to the circuit board 14.

The switch 10 further includes a manually depressible button 12 and first and second lightpipes 240 and 260 for conducting light from the light bulb 30 to the button 12. The lightpipes 240 and 260 are made of a transparent light conducting polymer. The first lightpipe 240 has a tubular center section 242 which encircles the light bulb 30. Locking tabs 244 project downward from the center section 242 and snap into the mounting holes 34 in the printed circuit board 14 to attach the first lightpipe 240 to the printed circuit board. Symmetrical first and second arcuate legs 246 and 248 extend circumferentially from the center section 242 and encircle a portion of the housing 40. Each of the arcuate legs 246 and 248 has an axially extending planar light conducting surface 250. The first lightpipe 240 further includes symmetrical third and fourth legs 252 and 254 which extend from the center section 242 in the opposite direction from the first and second legs 246 and 248.

The second lightpipe 260 has a U-shape defined by axially extending first and second beams 262 and 264 connected by a middle beam 266. Each of the first and second beams 262 and 264 has an axially extending planar light conducting surface 268. The light conducting surface 268 on the first beam 262 lies parallel to and axially overlaps the light conducting surface 250 on the first leg 246 of the first lightpipe 240. The light conducting surface 268 on the first beam 262 is laterally spaced from the light conducting surface 250 on the first leg 246 of the first lightpipe 240 by an air gap of approximately 1 mm. Similarly, the light conducting surface 268 on the second beam 264 lies parallel to and axially overlaps the light conducting surface 250 on the second leg 248 of the first lightpipe 240. The light conducting surface 268 on the second beam 264 is also laterally spaced from the light conducting surface 250 on the second leg 248 of the first lightpipe 240 an air gap of approximately 1 mm.

The middle beam 266 of the second lightpipe 260 includes a cup portion 270 which has a D-shape in cross-section. The cup portion 270 fits over the second body portion 114 of the shaft 110 to attach the second lightpipe 260 to the movable assembly 100. The middle beam 266 further includes two inclined surfaces 272 which have a sawtooth pattern for helping to reflect light. The button 12 is snap fit over the middle beam 266 of the second lightpipe 260. The button 12 includes lettering 280 made from a light conducting material and which is formed into the material of the button.

Figure 11:
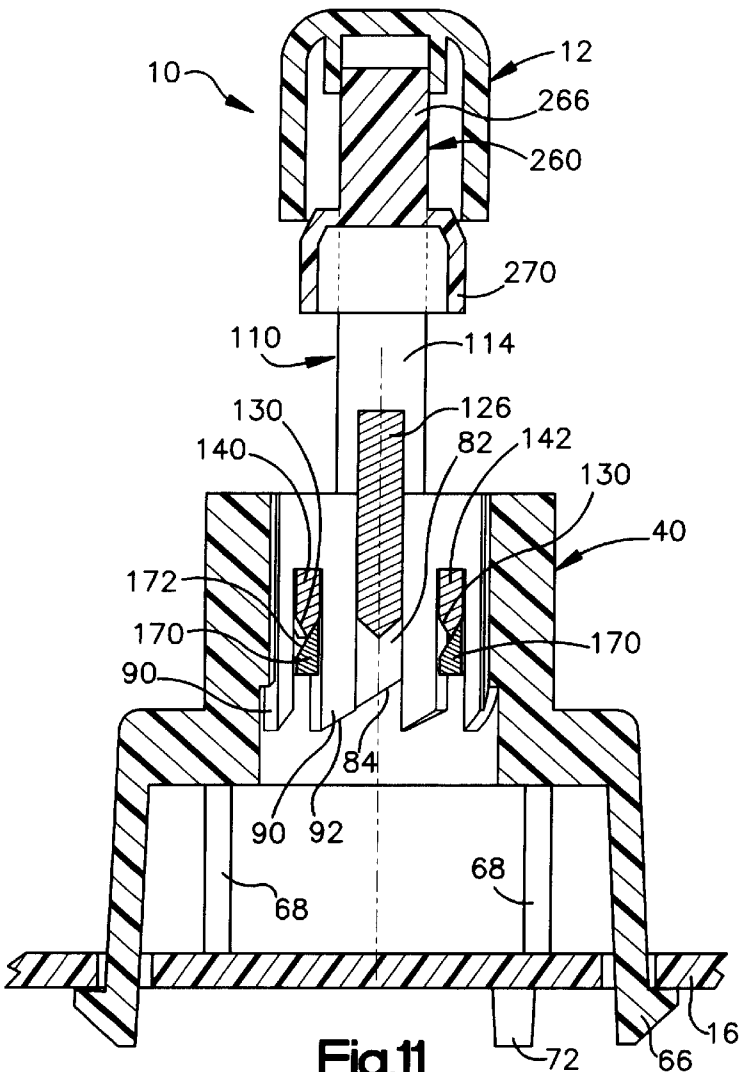
FIG. 11 is a sectional view taken along 11—11 in FIG. 10 illustrating the switch in a first axial position and with parts of the switch being omitted for clarity.

FIGS. 10 and 11 illustrate the switch 10 in a first axial position and the movable assembly 100 in a corresponding first condition. In this position, hereinafter referred to as the "normal" position, all of the automobile's power window switches (not shown) are electrically energized to operate the automobile's power windows. The window switches are energized because, in the first condition of the movable assembly 100, the contacts 198 on the rotor 180 are engaged with, and thus complete an electrical circuit through, the first trace 18 on the printed circuit board 14.

Referring now to FIG. 11, only the wedge portions 170 on the driver 150 are shown for clarity. In the normal position for the switch 10, the angled surfaces 172 on the four wedge portions 170 are engaged with the two teeth 130 on the projections 140 on the shaft 110, and with the two teeth 130 formed under the legs 142 on the shaft.

Figure 12:
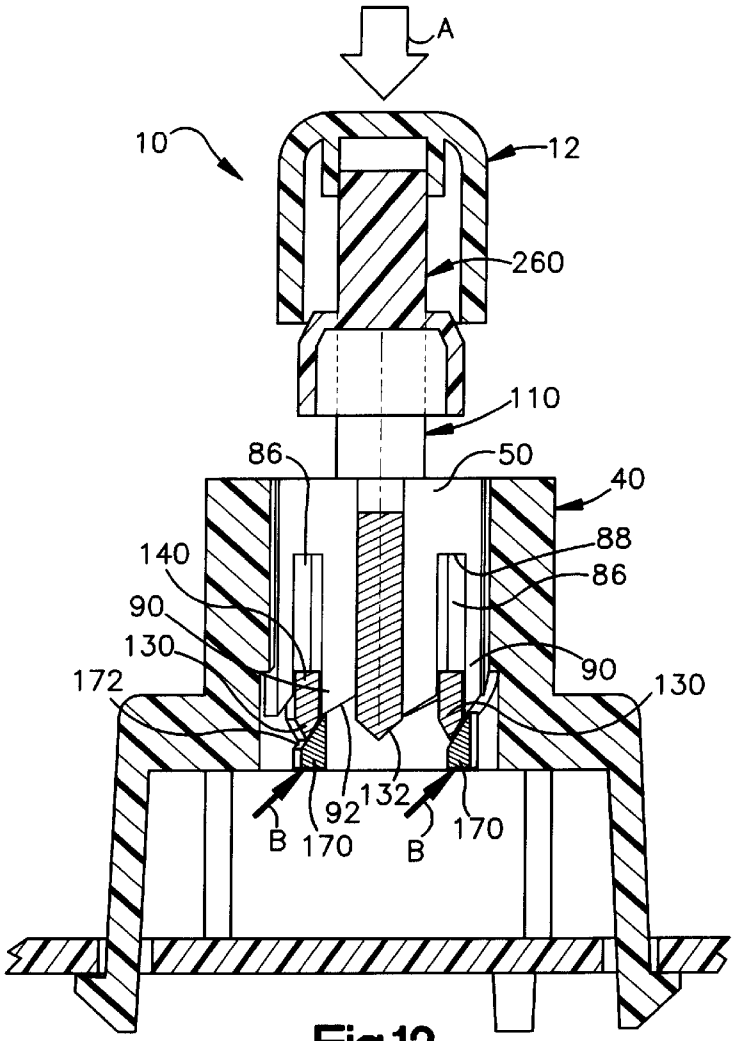
FIG. 12 is a sectional view similar to FIG. 11 illustrating the parts of the switch in an intermediate position.

FIG. 12 illustrates the switch 10 in a temporary intermediate position which occurs when the button 12 is manually depressed, as indicated by arrow A, from the normal position of FIG. 11. The shaft 110, to which the button 12 is connected by the second lightpipe 260, is pushed downward in the direction of arrow A, causing the driver 150 to move downward against the bias of the spring 220. The rotor 180, however, does not move axially. As shown in FIG. 12, when the driver 150 is moved far enough downward so that the angled surfaces 172 on the wedge portions 170 are below the angled guide surfaces 92 on the housing guide bars 90, the bias of the spring 220 pushes the driver upward and causes the angled surfaces 172 on the wedge portions 170 to engage the angled guide surfaces 92 on the guide bars 90. The force of the spring 220 and the cooperation of the angled surfaces 172 on the wedge portions 170 with the angled guide surfaces 92 on the guide bars 90 moves the driver 150 in the direction of arrows B in FIG. 12, causing the driver to begin to rotate relative to the shaft 110 and the housing 40. In order for this rotation to occur, the meshed teeth 162 and 130 on the driver 150 and on the shaft 110, respectively, disengage briefly.

Figure 3:
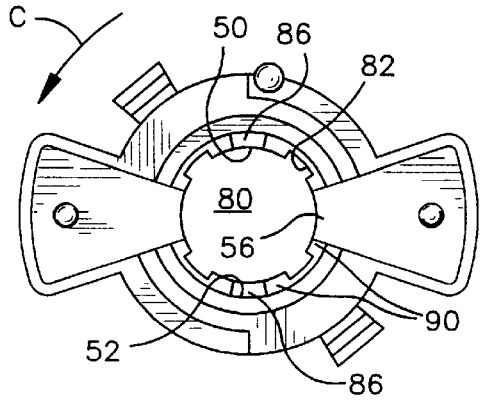
FIG. 3 is an end view taken along line 3—3 in FIG. 2.
Figure 13:
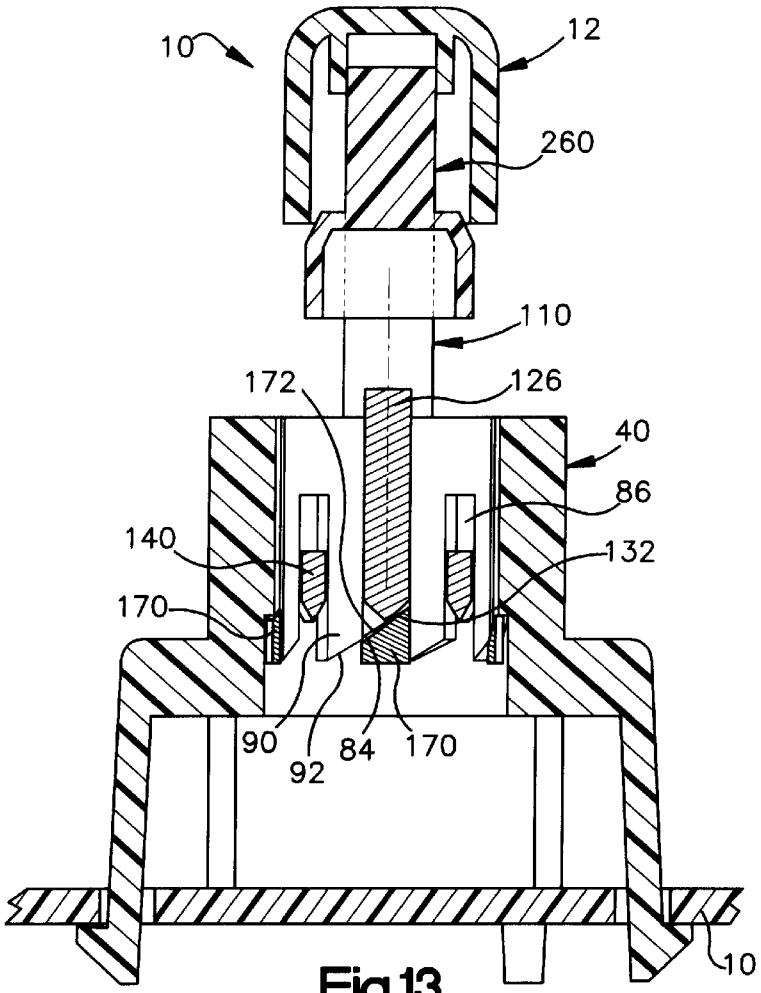
FIG. 13 is a sectional view similar to FIG. 11 illustrating the parts of the switch in a second axial position.

Under the force of the spring 220, the wedge portions 170 on the driver 150 then slide across the angled guide surfaces 92 on the guide bars 90, causing the driver to rotate in a counter clockwise direction as indicated by arrow C in FIG. 3. The wedge portions 170 continue sliding over the angled guide surfaces 92 and onto the angled housing surfaces 84 at the ends of the minor grooves 82 in the housing 40. This sliding movement rotates the driver 150 into a second condition shown in FIG. 13. The teeth 162 on the driver 150, having indexed one tooth over in the counterclockwise direction, mesh once again with the teeth 130 on the shaft 110. The spring 220 pushes the driver 150, and thus the shaft 110 and the button 12, upward and places the button in a second axial position for the switch 10. The second axial position is lower (i.e. closer to the printed circuit board) than the first axial position for the switch 10, as may be seen by comparing FIG. 13 to FIG. 11.

The second axial position of the switch 10 and the corresponding second condition of the movable assembly 100 constitute a position hereinafter referred to as the "lockout" position. In the lockout position, the angled surfaces 172 on the wedge portions 170 on the driver 150 engage the angled housing surfaces 84 at the ends of the minor grooves 82. The wedge portions 170 are also engaged by the first angled surfaces 132 which partially define four of the eight teeth 130 on the lower end surface 128 of the shaft 110 and which are located at the ends of the ridges 126 on the shaft.

When the driver 150 rotates into the lockout position, the rotor 180 also rotates so that the contacts 198 move from the first trace 18 on the printed circuit board 14 to the second trace 20. The electrical circuit then completed through the second trace 20 electrically disables the automobile's power window switches (not shown) which are located adjacent each of the passenger windows, while the other power window switches (not shown) in the arm rest panel near the driver remain operable to control each of the passenger windows. With the button 12 in the lockout position, passengers are thus prevented from opening or closing the power window adjacent their respective seat in the automobile.

Figure 14:
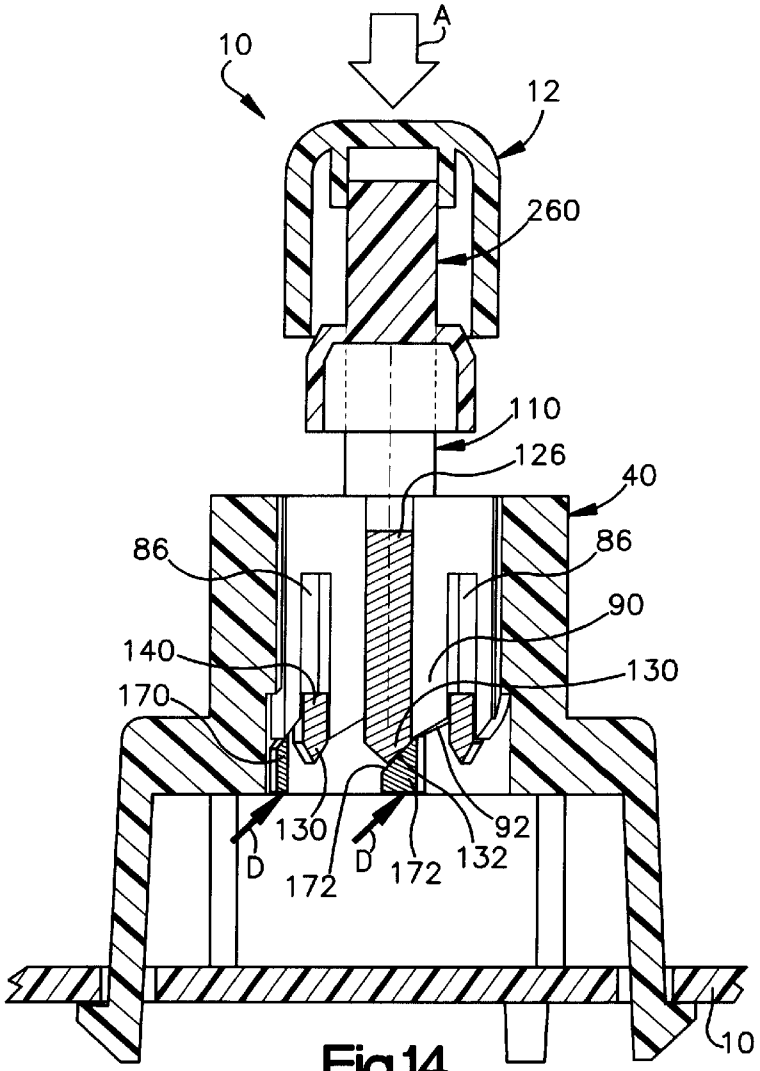
FIG. 14 is a sectional view similar to FIG. 11 illustrating the parts of the switch in another intermediate position.

To return the switch 10 to the normal position of FIG. 11, the button 12 is manually depressed manually, as indicated by arrow A, to a temporary intermediate position illustrated in FIG. 14. The shaft 110, to which the button 12 is connected by the second lightpipe 260, is pushed downward in the direction of arrow A. The angled surfaces 132 on the ridges 126 on the shaft 110, which are engaged with the angled surfaces 172 on the wedge portions 170, push the driver 150 downward against the bias of the spring 220. As shown in FIG. 14, when the driver 150 is moved far enough downward so that the angled surfaces 172 on the wedge portions 170 are below the angled guide surfaces 92 on the housing guide bars 90, the bias of the spring 220 (FIGS. 1 and 2) pushes the driver 150 upward and causes the angled surfaces 172 on the wedge portions 170 to engage the angled guide surfaces 92 on the guide bars 90. The force of the spring 220 and the cooperation of the angled surfaces 172 on the wedge portions 170 with the angled guide surfaces 92 on the guide bars 90 moves the driver 150 in the direction of arrows D in FIG. 14, causing the driver to begin to rotate relative to the shaft 110 and the housing 40. In order for this rotation to occur, the meshed teeth 162 and 130 on the driver 150 and on the shaft 110, respectively, disengage briefly.

Under the force of the spring 220, the wedge portions 170 on the driver 150 then slide across the angled guide surfaces 92 on the guide bars 90, causing the driver 150 to rotate in the counter clockwise direction indicated by arrow C in FIG. 3. The wedge portions 170 continue sliding over the angled guide surfaces 92 and onto the two teeth 130 on the projections 140 on the shaft 110 and onto the two teeth 130 formed under the legs 142 on the shaft. This sliding movement rotates the driver 150 and returns the driver to the first condition shown in FIG. 11. The teeth 162 on the driver 150, having indexed one tooth over in the counterclockwise direction, mesh once again with the teeth 130 on the shaft 110. The spring 220 pushes the driver 150, and thus the shaft 110 and the button 12, upward and returns the button to the first axial position for the switch. When the driver 150 rotates back to the second condition, the rotor 180 also rotates so that the contacts 198 move from the second trace 20 on the printed circuit board 10 to the first trace 18. With the contacts 198 engaging the first trace 18, all of the window switches in the automobile are again electrically energized. Thus, as described above, each manual depression of the button 12 toggles the switch 10 between the normal position and the lockout position.

Another feature of the present invention concerns the illumination of the lettering 280 in the button 12. Light from the light bulb 30 is transmitted to the lettering 280 via the first and second lightpipes 240 and 260. The light shines through the center section 242 of the first lightpipe 240 surrounding the light bulb 30 and is channeled down the first and second arcuate legs 246 and 248 to the light conducting surface 250 at the terminal end of each of the arcuate legs. The light conducting surfaces 250 on the arcuate legs 246 and 248 conduct the light across the air gaps separating the light conducting surfaces 250 on the arcuate legs and the light conducting surfaces 268 on the first and second beams 262 and 264 of the second lightpipe 260. The light is received by the light conducting surfaces 268 on the beams 262 and 264 and is channeled up to the middle beam 266 of the second lightpipe 260. The sawtooth surfaces 272 in the middle beam 266 reflect the light upward to the transparent lettering 280 in the button 12 which overlies the middle beam 266 and the lettering is illuminated. The axial length of the light conducting surfaces 250 and 268 on the first and second lightpipes 240 and 260, respectively, is selected so that the light conducting surfaces axially overlap during all axial positions of the switch 10. This ensures that the lettering 280 in the button 12 is illuminated during all axial positions of the switch 10.

From the above description of the invention, those skilled in the art will perceive improvements, changes and modifications. For example, the second trace 20 on the printed circuit board 14 could be completely dead so that when the switch 10 is in the lockout position, all of the window rocker switches in the automobile, including those near the driver, are disabled. Such improvements, changes and modifications within the skill of the art are intended to be covered by the appended claims.

Having described the invention, we claim:

1. A pushbutton switch comprising:

a printed circuit board;

a light bulb mounted to said printed circuit board and extending along a first axis;

a first lightpipe mounted to said printed circuit board and encircling said light bulb, said first lightpipe being made of a transparent light conducting polymer and including a first light conducting surface;

an assembly located on a second axis which is parallel to and offset from said first axis, said assembly being axially movable between first and second axial positions;

a second lightpipe mounted to said assembly and movable relative to said first lightpipe, said second lightpipe being made of a transparent light conducting polymer; and a button mounted to said second lightpipe and having an illuminatable portion, said button being manually depressible toward said printed circuit board to move said assembly between said first and second axial positions;

said second lightpipe having a second light conducting surface lying parallel to and spaced laterally apart from said first light conducting surface of said first lightpipe, said first and second light conducting surfaces being axially overlapped in both of said first and second axial positions of said assembly to conduct light from said light bulb to said illuminatable portion of said button in both of said first and second axial positions.

2. The pushbutton switch of claim 1 wherein first lightpipe has a third light conducting surface and said second lightpipe has a fourth light conducting surface lying parallel to and spaced laterally apart from said third light conducting surface, said third and fourth light conducting surfaces being axially overlapped in both of said first and second axial positions of said assembly to conduct light from said light bulb to said illuminatable portion of said button in both of said first and second axial positions.

3. The pushbutton switch of claim 1 wherein assembly includes a rotatable assembly which rotates in response to said assembly being between moved between said first and second axial positions, said rotatable assembly, when rotated, toggles between first and second conditions which correspond to said first and second axial positions.

4. The pushbutton switch of claim 3 wherein said rotatable assembly has electrical contacts which face toward traces on said printed circuit board and selectively engage said traces depending on which of said first and second conditions said rotatable assembly is in.

5. A pushbutton switch comprising:

a printed circuit board having a first trace and a second trace spaced circumferentially apart about an axis;

a housing connected to said printed circuit board, said housing including a chamber centered on said axis;

a movable assembly centered on said axis and partially disposed in said chamber, said movable assembly having electrical contacts for engaging one or the other of said first and second traces on said printed circuit board;

a button connected with said movable assembly, said button being manually depressible toward said printed circuit board;

means for biasing said movable assembly and said button away from said printed circuit board;

means for rotating said movable assembly about said axis when said button is manually depressed toward said printed circuit board;

said movable assembly, when rotated, toggling between a first condition in which said first trace is engaged by said electrical contacts and a second condition in which said second trace is engaged by said electrical contacts;

a light bulb mounted to said printed circuit board; and means for conducting light from said light bulb to an illuminatable portion of said button, said light bulb being located on a bulb axis which is parallel to and offset from said axis;

said means for conducting light comprising a first lightpipe mounted to said printed circuit board and encircling said light bulb and a second lightpipe mounted to said movable assembly, said first and second lightpipes being made of a translucent light conducting polymer and having laterally spaced apart light conducting surfaces which at least partially axially overlap at all times to conduct light for illuminating said illuminatable portion of said button, said button being mounted on said second lightpipe.

6. A pushbutton switch comprising:

a printed circuit board having a first trace and a second trace spaced circumferentially apart about an axis;

a housing connected to said printed circuit board, said housing including a chamber centered on said axis;

a movable assembly centered on said axis and partially disposed in said chamber, said movable assembly having electrical contacts for engaging one or the other of said first and second traces on said printed circuit board;

a button connected with said movable assembly, said button being manually depressible toward said printed circuit board;

means for biasing said movable assembly and said button away from said printed circuit board;

means for rotating said movable assembly about said axis when said button is manually depressed toward said printed circuit board;

said movable assembly, when rotated, toggling between a first condition in which said first trace is engaged by said electrical contacts and a second condition in which said second trace is engaged by said electrical contacts;

said movable assembly comprising a rotor, an axially movable shaft, and a rotatable driver operatively coupling said shaft with said rotor; and means for axially biasing said shaft away from said housing to reduce audible noise generated by vibration of said shaft within said housing, said means for axially biasing said shaft away from said housing comprising a pair of springs.

7. The pushbutton switch of claim 6 wherein said button, when manually depressed, toggles between first and second axial positions, said movable assembly being in said first condition when said button is in said first axial position and said movable assembly being in said second condition when said button is in said second axial position.

8. The pushbutton switch of claim 6 wherein said electrical contacts are located on surfaces of said rotor which face toward said printed circuit board.

9. The pushbutton switch of claim 6 wherein said shaft moves axially within said chamber in said housing whenever said button is manually depressed.

10. The pushbutton switch of claim 9 wherein said rotor is drivingly connected with said driver for rotation with said driver.

11. The pushbutton switch of claim 10 wherein said driver moves axially with said shaft and has angled surfaces which engage driving surfaces inside said chamber in said housing to cause said driver to rotate whenever said button is manually depressed.

12. The pushbutton switch of claim 11 wherein said means for biasing said movable assembly and said button away from said printed circuit board comprises a spring disposed between said rotor and said driver.

13. The pushbutton switch of claim 6 further comprising a light bulb mounted to said printed circuit board and means for conducting light from said light bulb to an illuminatable portion of said button, said light bulb being located on a bulb axis which is parallel to and offset from said axis.

14. The pushbutton switch of claim 13 wherein said means for conducting light comprises a first lightpipe mounted to said printed circuit board and encircling said light bulb and a second lightpipe mounted to said movable assembly, said first and second lightpipes being made of a translucent light conducting polymer and having laterally spaced apart light conducting surfaces which at least partially axially overlap at all times to conduct light for illuminating said illuminatable portion of said button, said button being mounted on said second lightpipe.

* * * * *